US010706643B2

(12) United States Patent
Yang et al.

(10) Patent No.: US 10,706,643 B2
(45) Date of Patent: Jul. 7, 2020

(54) APPARATUS AND SYSTEM FOR ACQUIRING NON-STANDARD PARAMETER ID, AND THE METHOD THEREOF

(71) Applicant: CENTER FOR INTEGRATED SMART SENSORS FOUNDATION, Daejeon (KR)

(72) Inventors: Jin Young Yang, Daejeon (KR); Jae Hyung Park, Daejeon (KR); Yunju Baek, Daejeon (KR); Yongsoo Chun, Daejeon (KR); Jaebong Lim, Daejeon (KR)

(73) Assignee: Center for Integrated Smart Sensors Foundation, Yuseong-Gu, Daejeon (KR)

( * ) Notice: Subject to any disclaimer, the term of this patent is extended or adjusted under 35 U.S.C. 154(b) by 0 days.

(21) Appl. No.: 16/052,851

(22) Filed: Aug. 2, 2018

(65) Prior Publication Data

US 2019/0043272 A1 Feb. 7, 2019

(30) Foreign Application Priority Data

Aug. 2, 2017 (KR) ..... 10-2017-0097946

(51) Int. Cl.
*G07C 5/00* (2006.01)
*G07C 5/08* (2006.01)

(52) U.S. Cl.
CPC ..... *G07C 5/008* (2013.01); *G07C 5/085* (2013.01); *G07C 2205/02* (2013.01)

(58) Field of Classification Search
CPC ..... G07C 2205/02; G07C 5/008; G07C 5/085
USPC ..... 701/31.4
See application file for complete search history.

(56) References Cited

U.S. PATENT DOCUMENTS 9,619,203 B2 * 4/2017 Tamir ..... G06Q 30/0283
2012/0296567 A1 * 11/2012 Breed ..... G01C 21/26 701/468
2014/0306799 A1 * 10/2014 Ricci ..... H04N 21/41422 340/5.83
2014/0306826 A1 * 10/2014 Ricci ..... B60R 25/01 340/573.1
2015/0057875 A1 * 2/2015 McGinnis ..... G05B 19/418 701/31.6
2015/0365979 A1 * 12/2015 Park ..... H04L 67/12 455/404.2
2016/0086397 A1 * 3/2016 Phillips ..... B60R 16/037 701/32.4
2016/0223350 A1 * 8/2016 Lewis ..... G01C 21/3407
(Continued)

FOREIGN PATENT DOCUMENTS

KR 10-2016-0071980 6/2016
KR 10-2016-0136139 11/2016
(Continued)

*Primary Examiner* — Atul Trivedi
(74) *Attorney, Agent, or Firm* — McCracken & Gillen LLC

(57) ABSTRACT

This invention relates to an apparatus and system for acquiring non-standard PID corresponding to non-standard operation of a vehicle by using selection input of a user received through a user terminal and OBD data collected from an OBD (On Board Diagnostics) terminal in a vehicle, and the method thereof, and non-standard PID of non-standard operation of a vehicle may be acquired through simple operation of a user terminal regardless of types of vehicles.

12 Claims, 10 Drawing Sheets

(56) References Cited

U.S. PATENT DOCUMENTS

| | | | | |
|---|---|---|---|---|
| 2017/0076515 | A1* | 3/2017 | Nyalamadugu | G07C 5/0808 |
| 2017/0089274 | A1* | 3/2017 | Kolhouse | F02D 41/0002 |
| 2017/0263061 | A1* | 9/2017 | Mann | G07C 5/0808 |
| 2018/0025430 | A1* | 1/2018 | Perl | G01C 21/3697 705/4 |
| 2018/0237026 | A1* | 8/2018 | Chowdhury | B60W 40/09 |
| 2018/0278896 | A1* | 9/2018 | Schimelpfenig | H04N 7/181 |
| 2018/0341888 | A1* | 11/2018 | Kislovskiy | G06Q 10/0635 |
| 2019/0005412 | A1* | 1/2019 | Matus | G06N 20/00 |
| 2019/0056745 | A1* | 2/2019 | Meehan | B60L 58/10 |
| 2019/0066535 | A1* | 2/2019 | Pifko | G07C 5/085 |

FOREIGN PATENT DOCUMENTS

| | | |
|---|---|---|
| KR | 10-2017-0087182 | 7/2017 |
| WO | WO 2004-044598 | 5/2004 |

* cited by examiner

APPARATUS AND SYSTEM FOR ACQUIRING NON-STANDARD PARAMETER ID, AND THE METHOD THEREOF

This application claims the priority benefit of Korean Patent Application No. 10-2017-0097946, filed on Aug. 2, 2017, in the Korean Intellectual Property Office, the disclosure of which is incorporated herein by reference.

BACKGROUND

1. Field of the Invention

The following example embodiments relate to apparatus and system for acquiring non-standard PID (Parameter ID), and the method thereof, more particularly, a technology for acquiring non-standard PID corresponding to a non-standard operation of a vehicle by using selection input of a user received through a user terminal and OBD (On Board Diagnostics) data collected from an OBD terminal in a vehicle.

2. Description of the Related Art

Recently various ADAS (Advance Driving Assistance System) technologies have been combined into a Black-Box for vehicles, and it makes the value of the Black-Box enhance. The ADAS technologies which are most commonly used in the Black-Box are LDW (Lane Departure Warning), FCW (Forward Collision Warning), and FVSA (Forward Vehicle Start Alarm).

The LDW technology among the above described ADAS technologies is a technology for determining whether a vehicle departure from a lane by processing video acquiring from a front camera in a Black-Box, and providing a determining result to a user.

More particularly, the LDW technology does not provide an alarm by determining that a driver properly changes direction if a turn signal of a corresponding direction is turned on when a vehicle departure a lane. However, when a vehicle departure a lane, if a turn signal is not turned on or a turn signal of the opposite direction is turned on, the LDW technology provide an alarm to a driver by determining that the driver is careless.

Here, the LDW technology has to detect whether a turn signal of a vehicle is turned on, and to detect this, various methods are used. Here, the various methods are a method for acquiring whether the corresponding turn signal is turned on through an OBD (On Board Diagnostics) terminal in a vehicle, a method for acquiring whether a turn signal is turned on through video processing by installing a camera on the top of dashboard, a method for determining whether a turn signal is operated through change of acceleration sensor value by including an acceleration sensor in a turn signal knob, and the like.

Among the methods, a method for acquiring OBD data in a vehicle which is most commonly used is a method for storing a PID (Parameter ID) corresponding to turn signals in OBD data according to types of vehicles in advance, and verifying whether the corresponding PID is right if a user selects a vehicle type when installing a Black-Box.

However, the existing method for acquiring OBD data in a vehicle has a disadvantage that it is necessary to know PID for all vehicles sold in advance. Also, it needs to acquire PID value of turn signals in OBD data corresponding to new vehicles of existing brand or types of brand vehicles released in a new market in advance and store the PID value in a Black-Box. In this case, there is a limit that Black-Box products always have to come out after a certain period of time after new vehicles are released.

Furthermore, besides the LDW technology, the FCW technology and the FVSA technology also have a limit that it is necessary to acquire a specific PID of vehicles to provide a corresponding service.

Accordingly, there is a demand for a technology for acquiring a specific PID (hereinafter referred to as "non-standard PID") of a necessary vehicle through a simple operation without acquiring and storing a specific PID of a vehicle in advance.

Prior Art Reference

Korean Patent Publication No. 10-2016-0136139 (Nov. 29, 2016, Publication), "Vehicle management apparatus using mobile terminal and method thereof".

Korean Patent Publication No. 10-2016-0071980 (Jun. 22, 2016, Publication), "Injector diagnosis method and system for OND2"

SUMMARY

At least one example of embodiments may provide apparatus and system for acquiring non-standard PID (Parameter ID), and the method thereof which may acquire a non-standard PID in a non-standard operation of a vehicle through a simple operation of a user terminal regardless of types of vehicles.

Also, at least one example of embodiments may provide apparatus and system for acquiring non-standard PID (Parameter ID), and the method thereof which may monitor a non-standard PID of a vehicle by matching and managing a non-standard PID corresponding to a non-standard operation by VIN (Vehicle Identification Number) of vehicles.

According to at least one example of embodiments, an apparatus for acquiring non-standard PID (Parameter ID) may include an OBD (On Board Diagnostics) data collecting unit configured to collect OBD data according to a non-standard operation of a vehicle connected to an OBD terminal in the vehicle, a PID (Parameter ID) extracting unit configured to extract a non-standard PID corresponding to the non-standard operation by using the collected OBD data after an instruction signal generated by a user terminal, a PID monitoring unit configured to store the non-standard PID corresponding to the vehicle, and monitoring the non-standard PID generated according to the non-standard operation, and a controlling unit configured to receive the instruction signal according to selection input of a user which is input to the user terminal, transmit a monitoring result of the non-standard PID, and output an output signal according to the monitoring result of the non-standard PID.

The OBD data collecting unit may collect the OBD data generated in the OBD terminal by the non-standard operation of changing turn signals and gear positions of the vehicle.

The PID extracting unit may include an instruction receiving module receiving the instruction signal generated from the selection input of the user in order to acquire the non-standard PID, an OBD receiving module receiving preprocessed OBD data for the non-standard operation performed by the user after the instruction signal, and a non-standard PID extracting module extracting the non-standard PID corresponding to the non-standard operation performed by the user based on the instruction signal.

The instruction receiving module may receive the selection input of the user for the non-standard operation of at least any one of the turn signals of left, right, and light-off and the gear positions of P (Parking), R (Reverse), N (Neutral), and D (Drive).

The OBD receiving module may detect the instruction signal according to the selection input of the user for the non-standard operation, and receive the preprocessed OBD data according to the non-standard operation generated after the instruction signal.

The PID monitoring unit may match and store the vehicle, the non-standard operation, and the non-standard PID.

The PID monitoring unit may monitor the non-standard PID generated by the non-standard operation of the vehicle based on the stored data.

The controlling unit may transmit a monitoring result of the non-standard PID to the user terminal and an external server, and output the result through an outputting module in the vehicle.

According to another aspect of at least one example of embodiments, a system for acquiring non-standard PID (Parameter ID) may include an apparatus for acquiring non-standard PID (Parameter ID) extracting a non-standard PID corresponding to a non-standard operation of a vehicle by using collected OBD (On Board Diagnostics) data after an instruction signal according to selection input of a user connected to an OBD terminal in the vehicle, and monitoring the non-standard PID generated according to the non-standard operation, a user terminal transmitting the instruction signal according to the selection input of the user, and receiving and providing a monitoring result of the non-standard PID, and an external server matching and managing the vehicle, the non-standard operation, and the non-standard PID.

The apparatus for acquiring non-standard PID may include an OBD data collecting unit configured to collect the OBD data according to the non-standard operation of the vehicle connected to the OBD terminal in the vehicle, a PID extracting unit configured to extract the non-standard PID corresponding to the non-standard operation by using the collected OBD data after the instruction signal generated by the user terminal, a PID monitoring unit configured to store the non-standard PID corresponding to the vehicle, and monitor the non-standard PID generated according to the non-standard operation, and a controlling unit configured to receive the instruction signal according to the selection input of the user which is input to the user terminal, transmit a monitoring result of the non-standard PID, and output an output signal according to the monitoring result of the non-standard PID.

The user terminal may display a plurality of icons for the non-standard operation of at least any one of turn signals of left, right, and light-off and gear positions of P (Parking), R (Reverse), N (Neutral), and D (Drive), and transmit the instruction signal according to the selection input of the user.

The user terminal may request the non-standard PID corresponding to the non-standard operation for the vehicle to the external server.

The external server may be configured to match and manage the non-standard PID corresponding to the non-standard operation by VIN (Vehicle Identification Number) of vehicles.

The apparatus for acquiring non-standard PID may be configured to be connected to or included in a Black-Box of the vehicle.

According to another aspect of at least one example of embodiments, a method for acquiring non-standard PID (Parameter ID), wherein an operation method of an apparatus for acquiring non-standard PID may include being connected to an OBD (On Board Diagnostics) terminal in a vehicle, and collecting OBD data according to a non-standard operation of the vehicle, determining whether the non-standard PID according to the non-standard operation of the vehicle is stored based on the collected OBD data, monitoring the non-standard PID generated according to the non-standard operation of the vehicle when the non-standard PID corresponding to the vehicle is stored based on the determining result, and outputting a monitoring result of the non-standard PID.

According to another aspect of at least one example of embodiments, a method for acquiring non-standard PID (Parameter ID), wherein an operation method of an apparatus for acquiring non-standard PID may include being connected to an OBD (On Board Diagnostics) terminal in a vehicle, and collecting OBD data according to a non-standard operation of the vehicle, determining whether the non-standard PID according to the non-standard operation of the vehicle is stored based on the collected OBD data, receiving an instruction signal according to selection input of a user which is input to a user terminal when the non-standard PID corresponding to the vehicle is not stored based on the determining result, collecting preprocessed OBD data according to the non-standard operation of the vehicle, and extracting and storing the non-standard PID corresponding to the non-standard operation by using the preprocessed OBD data which is collected after the received instruction signal.

According to example embodiments, a non-standard PID in a non-standard operation of a vehicle may be acquired through a simple operation of a user terminal regardless of types of vehicles.

Also, according to example embodiments, ADAS service may be provided by using OBD data of a vehicle based on an acquired non-standard PID.

Also, according to example embodiments, a non-standard PID of a vehicle may be monitored by matching and managing a non-standard PID corresponding to a non-standard operation by VIN (Vehicle Identification Number) of vehicles.

BRIEF DESCRIPTION OF THE DRAWINGS

These and/or other aspects, features, and advantages of the invention will become apparent and more readily appreciated from the following description of embodiments, taken in conjunction with the accompanying drawings of which.

DETAILED DESCRIPTION

Figure 1:
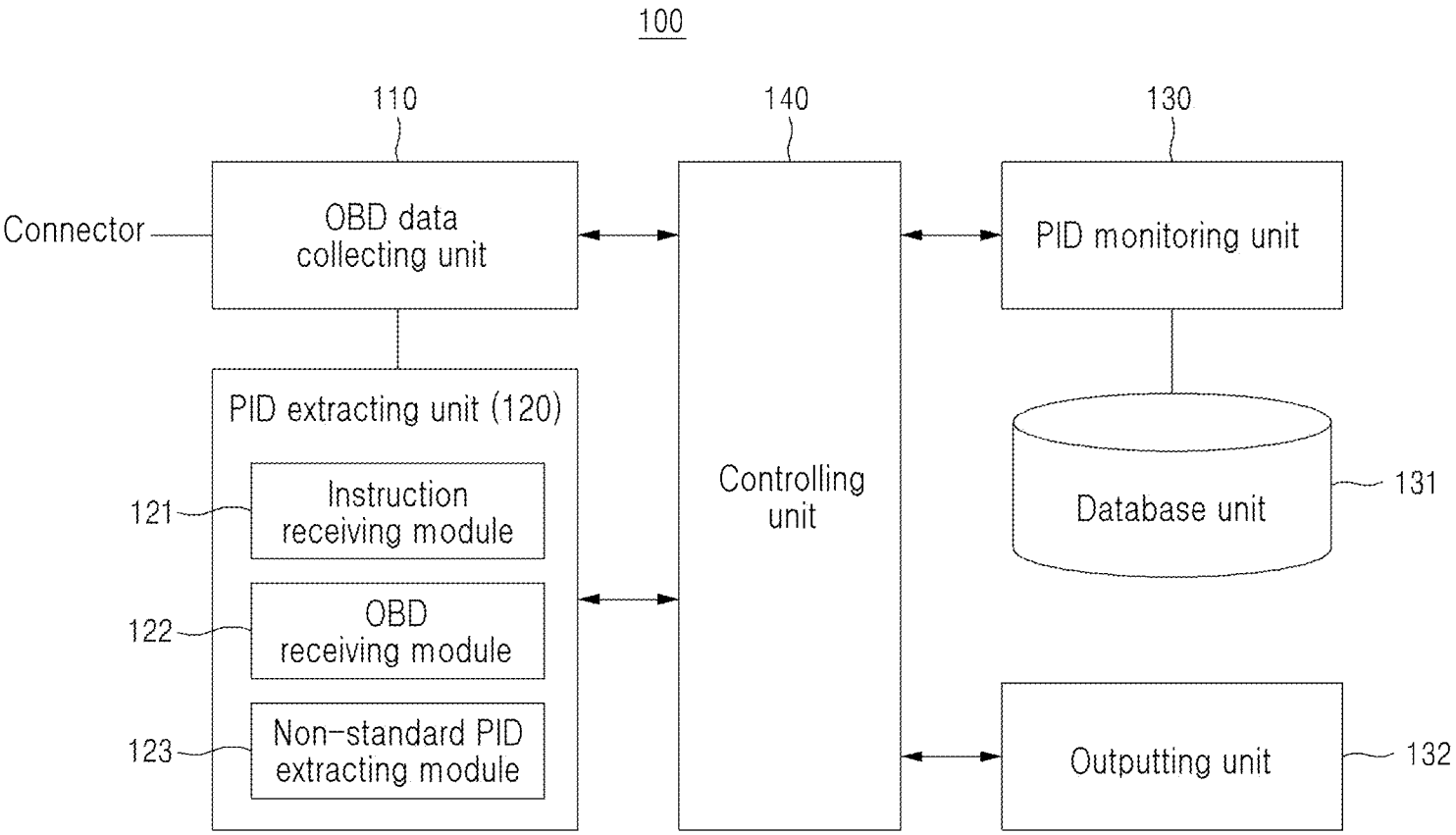
FIG. 1 is a drawing for describing a configuration of an apparatus for acquiring non-standard PID according to an example of embodiments.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings.

Also, terminologies used herein refer to terms used to appropriately represent the example embodiments and may vary based on a reader, the intent of an operator, or custom of a field to which this disclosure belongs, and the like. Accordingly, the definition of the terms should be made based on the overall description of the present specification.

FIG. 1 is a drawing for describing a configuration of an apparatus for acquiring non-standard PID according to an example of embodiments.

Referring to FIG. 1, an apparatus for acquiring non-standard PID 100 acquires and monitors a non-standard PID according to a non-standard operation of a vehicle by using selection input of a user received from a connected user terminal and OBD (On Board Diagnostics) data collected from an OBD terminal in the vehicle.

The apparatus for acquiring non-standard PID 100 includes an OBD data collecting unit 110, a PID extracting unit 120, a PID monitoring unit 130, and a controlling unit 140.

The OBD data unit 110 is connected to the OBD terminal in the vehicle and collects OBD data according to the non-standard operation of the vehicle.

For example, the apparatus for acquiring non-standard PID 100 may be connected to the OBD terminal in the vehicle by using a connector including a plurality of pin array forms and a communication method, and collect OBD data generated from the OBD terminal by the non-standard operation of the vehicle.

Here, in this invention, as the non-standard operation of the vehicle, an operation for changing turn signals and gear positions is mainly described, but the non-standard operation of the vehicle is not limited thereto, and may include various operations such as whether a seat belt is worn or not, window operation, lamp operation, and the like. In other words, the non-standard operation which is described in this invention may be motion for acquiring a non-standard PID excluding a standard PID relating to vehicle fault diagnosis.

According to embodiments, the apparatus for acquiring non-standard PID 100 may be an OBD terminal (On-Board Diagnostics terminal) or an OBD scanner (On-Beard Diagnostics scanner).

Furthermore, the apparatus for acquiring non-standard PID 100 which is the ODB terminal or the OBD scanner may detect vehicle diagnosis information including sensor information and driving information as well as operation information in the vehicle by being mounted in the vehicle.

The apparatus for acquiring non-standard PID 100 is a self-diagnosis terminal receiving status information for at least one mounted device mounted on the vehicle. Here, the apparatus for acquiring non-standard PID 100 is capable of self-diagnosis of the vehicle by informing information for main system of the vehicle or information for breakdown and the like transmitted to in-vehicle ECU (Electronic Control Unit) from at least one or more sensors mounted on the vehicle by using serial communication function.

Such OBD (On-Board Diagnostics) which is a term used in automotive industry receives sensor information from sensors for various measurements and controls in recently produced vehicles, for example, an impact sensor, a temperature sensor, a pressure sensor, an acceleration sensor, a tire pressure sensor, a climate sensor, and the like. These sensors are controlled by the ECU. The ECU precisely controlled core functions of engine such as engine ignition timing and fuel injection, variable valve timing, idling, limit value setting, and the like, but may control all parts of a vehicle such as drive system, braking system, steering system, and the like including automatic transmission control with development of performance of vehicles and computers. Accordingly, the apparatus for acquiring nonstandard PID 100 may acquire and detect mileage, RPM (Revolutions Per Minute), speed, fuel-efficiency, battery voltage, cooling water exchange, idling time, and the like besides sensor information from the ECU.

The PID extracting unit 120 extracts the non-standard PID (Parameter ID) corresponding to the non-standard operation by using collected OBD data after an instruction signal generated by the user terminal.

More particularly, the PID extracting unit 120 may include an instruction receiving module 121 for receiving the instruction signal generated from selection input of the user, an OBD receiving module 122 for receiving preprocessed OBD data for the non-standard operation performed by the user after the instruction signal, and a non-standard PID extracting module 123 for extracting the non-standard PID corresponding to the non-standard operation performed by the user based on the instruction signal in order to acquire the non-standard PID according to the non-standard operation.

The instruction receiving module 121 may receive selection input of the user for the non-standard operation of at least any one of turn signals of left, right, and light-off and gear positions of P (Parking), R (Reverse), N (Neutral), and D (Drive) through the controlling unit 140.

For example, the user terminal may display a selection screen for acquiring a non-standard PID of the turn signals and a selection screen for acquiring a non-standard PID of the gear positions, and the user may select a button for the non-standard operation of the turn signals and the gear positions.

Accordingly, the instruction receiving module 121 may receive the selection input of the user through the controlling unit 140, and detect the instruction signal for acquiring the non-standard PID among the turn signals of left, right, and light-off and the gear positions of P (Parking), R (Reverse), N (Neutral), and D (Drive) based on the received selection input of the user.

After this, the OBD receiving module 122 may detect the instruction signal according to the selection input of the user for the non-standard operation, and receive preprocessed OBD data according to the non-standard operation generated after the instruction signal.

For example, OBD data collected through the OBD data collecting unit 110 is consist of a PID and payload. Accordingly, the OBD receiving module 122 may store OBD data together with a PID in a preprocessing process of the OBD data according to the non-standard operation after the instruction signal. According to embodiments, the acquired OBD data may be as follows.

<PID-111, D0>, <PID-111, D1>, <PID-222, N2>, <PID-222, L2>, <PID-222, L3>, <PID-333, N3>, <PID-555, N5>, <PID-555, L5>, <PID-555, L5>, <PID-666, N6>, <PID-666, N6>

However, because the above described data does not come in order in a real vehicle, the OBD receiving module 122 may arrange data in the preprocessing process by PID. For example, an example arranging the collected OBD data by PID is as below Table 1.

TABLE 1

| PID | OBD-II data | | |
|---|---|---|---|
| PID-111 | D0 | D1 | |
| PID-222 | N2 | L2 | L3 |
| PID-333 | N3 | | |
| PID-555 | N5 | L5 | L5 |
| PID-666 | N6 | N6 | |

Accordingly, the OBD receiving module 122 may receive the preprocessed OBD data according to the non-standard operation of the vehicle.

Afterwards, the non-standard PID extracting module 123 may extract the non-standard PID corresponding to the non-standard operation performed by the user based on the instruction signal.

For example, the non-standard PID extracting module 123 may extract the non-standard PID of the turn signals or the gear positions by using a cross pattern filter and a pattern ratio filter.

As an example embodiment, the cross pattern filter is a filter specifying and passing types of OBD data. For example, in case of the turn signals, because there are on and off states, only two types of OBD data may be passed, and in case of the gear positions, because there are four patterns (P, R, N, D), only four types OBD data may be passed.

Particularly, to use the above described Table 1 as an example, Table 1 indicates preprocessed OBD data when extracting the non-standard PID of the turn signals. Here, the non-standard PID extracting module 123 may indicate On/Off in Table 1, and extract PID-111 and PID-555 as the non-standard PID passing the cross pattern filter.

Also, as an example embodiment, the pattern ratio filter which is a filter passing OBD data whose ratio is 1:1 may be used to further limit the non-standard PID after applying the cross pattern filter. Especially, in case of the turn signals, because on and off states are repeated at regular intervals, the pattern ratio filter may be effectively applied.

Particularly, to use Table 1 as an example, PID-11 is at 1:1 ratio because each of D0 and D1 is one, while PID-555 is at 1:2 ratio because D0 and D1 are respectively one and two. As a result, the non-standard PID extracting module 123 may finally extract PID-111 as the non-standard PID of the turn signal.

In other words, the non-standard PID extracting module 123 may extract the non-standard PID for the non-standard operation of the turn signals and the gear positions by applying the above described cross pattern filter and pattern ratio filter, but it is not limited to the described filters, and various methods which may extract the non-standard PID from the preprocessed OBD data may be applied.

Also, the non-standard PID extracting module 123 may extract the non-standard PID for various operations such as whether a seat belt is worn or not, window operation, lamp operation, and the like besides the above described non-standard operation of the turn signals and the gear positions.

Referring to FIG. 1, the PID monitoring unit 130 of the apparatus for acquiring non-standard PID 100 stores the non-standard PID corresponding to the vehicle, and monitors the non-standard PID generated according to the non-standard operation.

The PID monitoring unit 130 may match and store the vehicle, the non-standard operation, and the non-standard PID.

For example, a database unit 131 may match and store the non-standard PID corresponding to various non-standard operations of turn signals, gear positions, whether a seat belt is worn or not, window operation, lamp operation, and the like by VIN (Vehicle Identification Number) of vehicles.

More particularly, the database unit 131 may match, store, and maintain the non-standard PID according to the non-standard operations of turn signals of left, right, light-off, gear positions of P (Parking), R (Reverse), N (Neutral), and D (Drive), whether seat belts of driver's seat, passenger seat, and left/right back seat are worn or not, driver's seat, passenger seat, and left/right back seat's windows operation, lamp operation of On/Off, and the like by VIN of vehicles.

The PID monitoring unit 130 may monitor the non-standard PID generated by the non-standard operation of the vehicle based on the non-standard PID which is stored and maintained in the database unit 131.

For example, the PID monitoring unit 130 may monitor whether the non-standard PID corresponding to the non-standard operation of the vehicle is a value stored and maintained in the database unit 131.

Furthermore, when it is the non-standard PID value acquired by the non-standard operation of the vehicle, the controlling unit 140 of the apparatus for acquiring non-standard PID 100 may provide the non-standard PID value through the external server, the user terminal or an outputting module in the vehicle, and when it is not the acquired non-standard PID value, the controlling unit 140 may control an operation for acquiring the non-standard PID from the OBD data collecting unit 110 and the PID extracting unit 120.

The controlling unit 140 receives the instruction signal according to selection input of the user which is input to the user terminal, transmits a monitoring result of the non-standard PID, and outputs an output signal according to the monitoring result of the non-standard PID.

For example, the controlling unit 140 may receive the instruction signal according to selection input of the user through a wireless communication method of Bluetooth with the user terminal, and transmit a monitoring result of the non-standard PID according to the non-standard operation of the vehicle.

Here, the controlling unit 140 may use a wireless communication method such as Wi-Fi Wireless LAN besides Bluetooth, and use wire communication methods such as Universal Serial Bus, IEEE 1394, Serial communication, and Parallel communication.

Also, the controlling unit 140 may output the monitoring result through the output module. For example, the controlling unit 140 may output warning sound by using an audio module, a speaker module, or a buzzer in a vehicle, or flicker a warning light by using LED (Light Emitting Diode), and output vibration by using a vibration module.

Figure 2A:
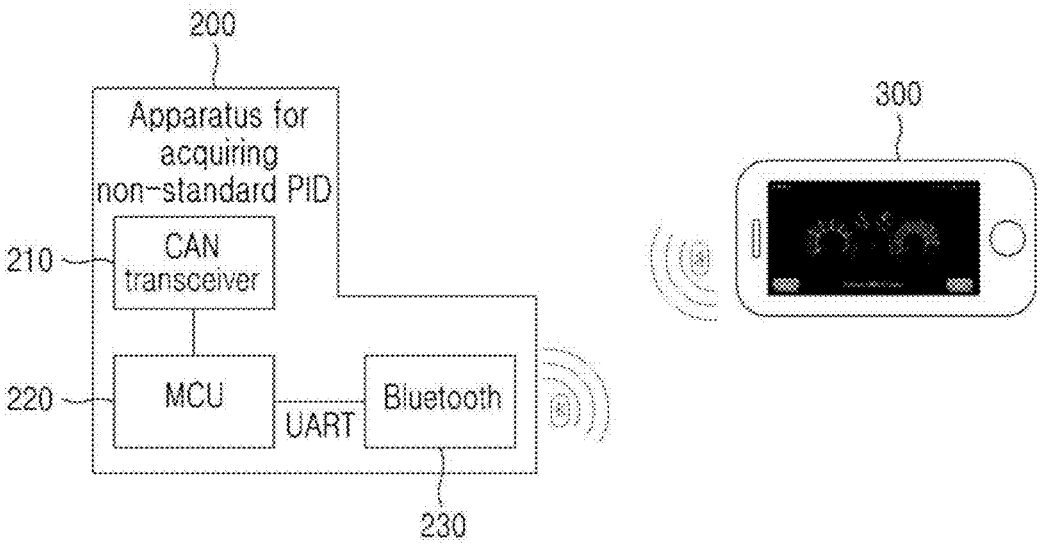
FIGS. 2A to 2C illustrate examples of block diagrams of an apparatus for acquiring non-standard PID connected to a user terminal according to an example of embodiments.
Figure 2B:
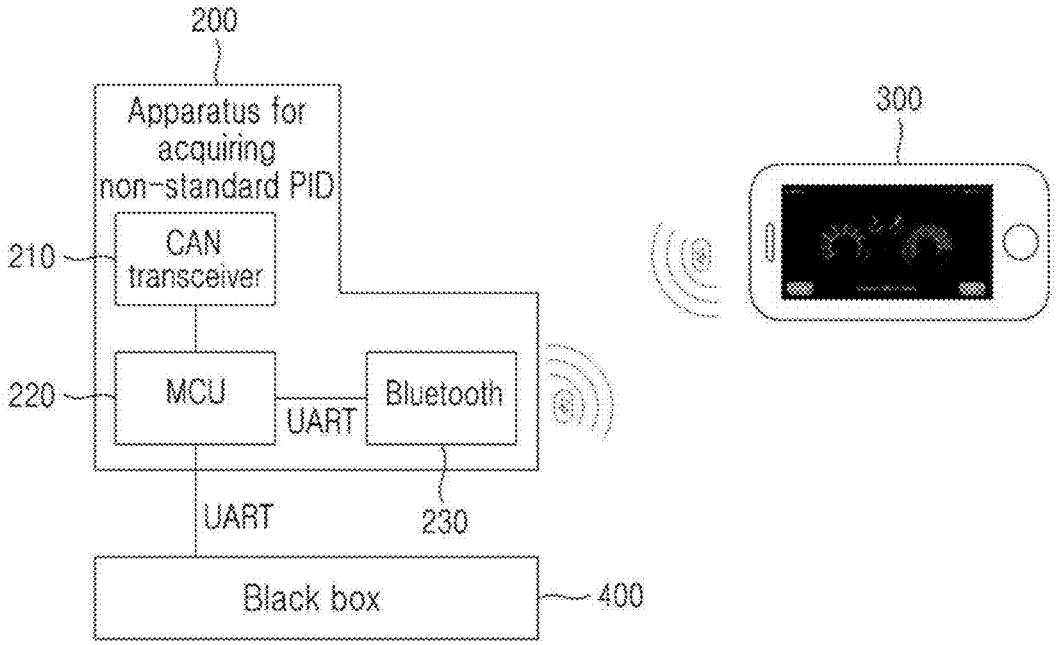
Figure 2C:
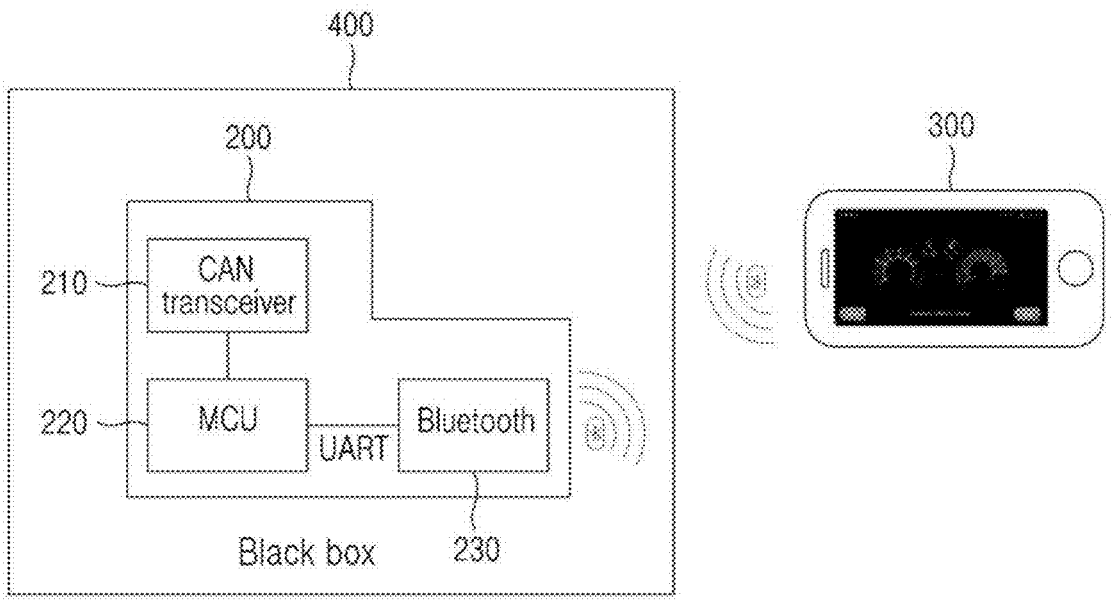
Figure 3:
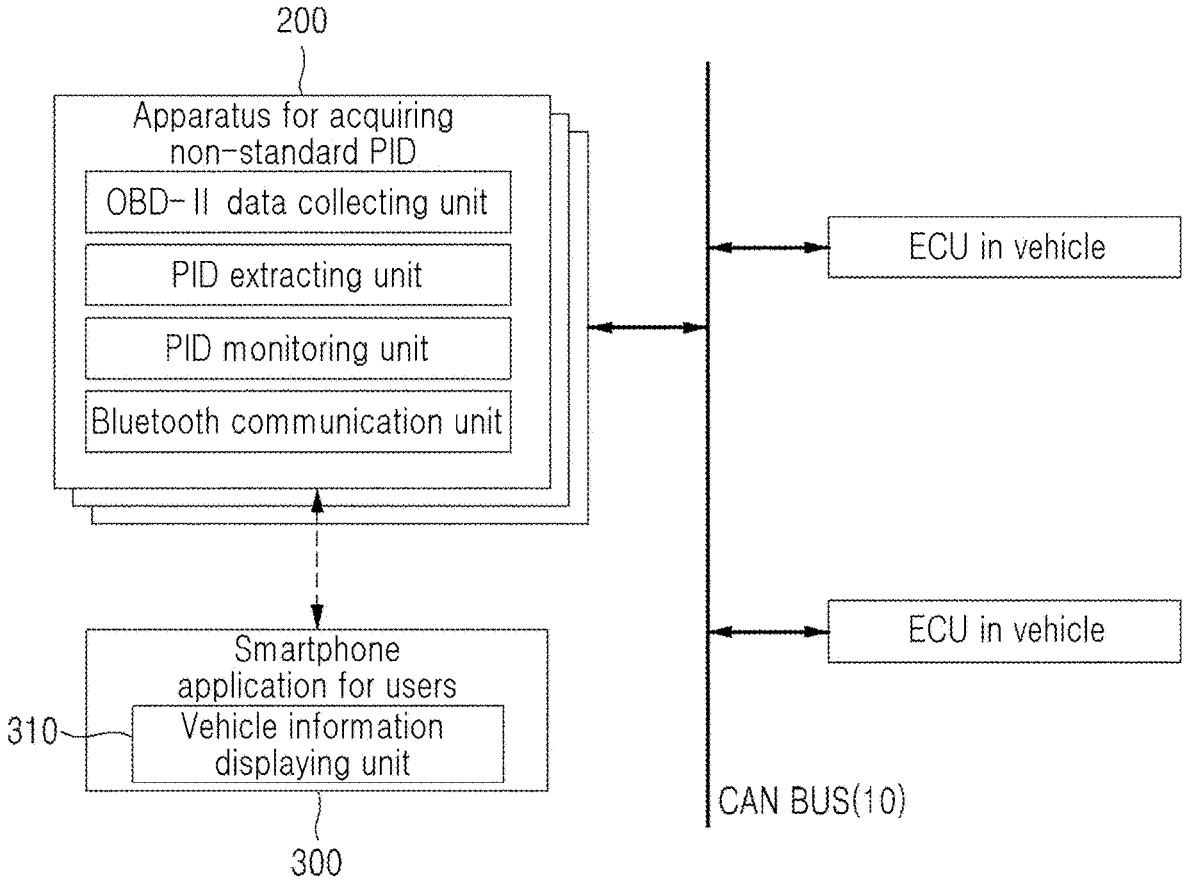
FIG. 3 illustrates an example of CAN communication according to an example of embodiments.

FIGS. 2A to 2C illustrate examples of block diagrams of an apparatus for acquiring non-standard PID connected to a user terminal according to an example of embodiments, and FIG. 3 illustrates an example of CAN communication according to an example of embodiments.

More particularly, FIG. 2A illustrates an example of a block diagram of an apparatus for acquiring non-standard PID connected to a user terminal according to an example of embodiments, FIG. 2B illustrates an example of a block diagram of an apparatus for acquiring non-standard PID connected to a Black-Box according to an example of embodiments, and FIG. 2C illustrates an example of an example of a block diagram of an apparatus for acquiring non-standard PID connected to a user terminal and included in a Black-Box according to an example of embodiments.

Referring to FIGS. 2A to 2C and 3, an apparatus for acquiring non-standard PID 200 may include an MCU (Micro Control Unit) 220, and include a CAN (Controller Area Network) transceiver 210 collecting in-vehicle OBD data from an ECU (Electronic Control Unit) in a vehicle through a CAN communication. Here, the MCU 220 may be a role of the controlling unit 140 of FIG. 1.

Also, the apparatus for acquiring non-standard PID 200 may receive selection input of a user from a user terminal 300 by using a wireless communication method of Bluetooth 230 of a UART (Universal asynchronous receiver/transmitter) connection, and provide user experience to the user by transmitting information according to the received selection input of the user.

Referring to FIG. 2A, the apparatus for acquiring non-standard PID 200 exists in an independent form, and may perform data receiving and transmitting with the user terminal 300.

However, referring to FIG. 2B, the apparatus for acquiring non-standard PID 200 may exist in a form connected with a Black-Box 400, and referring to FIG. 2C, the apparatus for acquiring non-standard PID 200 may exist in a form included in the Black-Box 400.

Here, in FIG. 2B, the apparatus for acquiring non-standard PID 200 may communicate with the Black-Box 400 through the UART (Universal asynchronous receiver/transmitter), and communicate by connecting with wire and wireless communication channel.

According to embodiments, the Black-Box 400 may be connected with ADAS technology or a backup camera, and a non-standard PID acquired from the apparatus for acquiring non-standard PID 200 may be used in various ADAS services.

The user terminal 300 of FIGS. 2A to 2C and 3 which is a terminal device possessed by a user may be at least any one of a PC (Personal Computer), a laptop computer, a smart phone, a tablet, and a wearable computer. Also, the user terminal 300 may receive information according to selection input of the user, may be a device including vehicle information displaying unit 310 in a screen form which may perform an operation of a prescribed set of functions through a screen including touch-sense area, and may be a device including one or more physical buttons or virtual buttons. Therefore, types and forms are not limited thereto.

Also, the user terminal 300 may include an application processor for data receiving and transmitting with an external server and the apparatus for acquiring non-standard PID 200, control command generating, and display, and may be a device operated by the application processor.

Figure 4A:
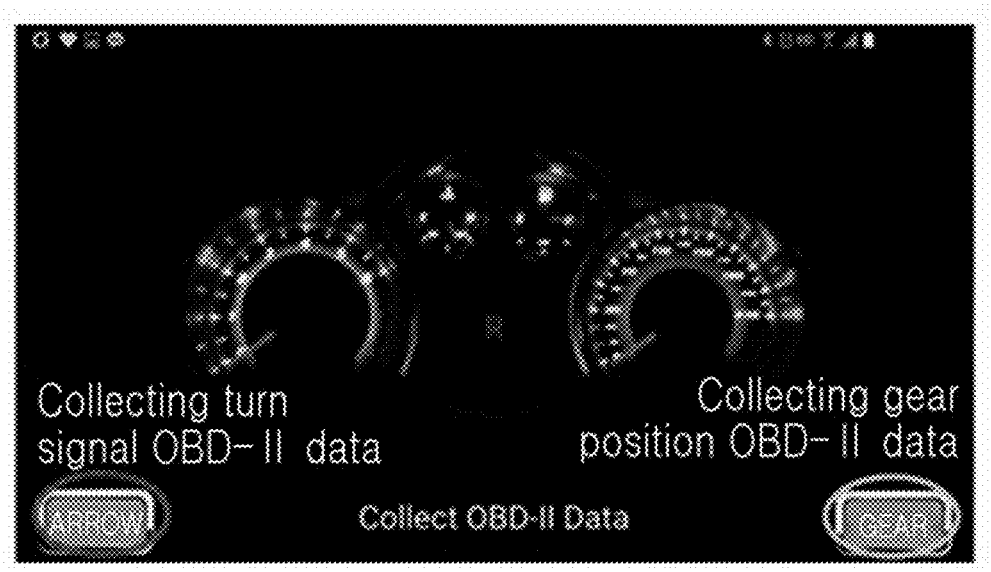
FIGS. 4A to 4C illustrate examples of a display provided for receiving selection input of a user according to example embodiments.
Figure 4B:
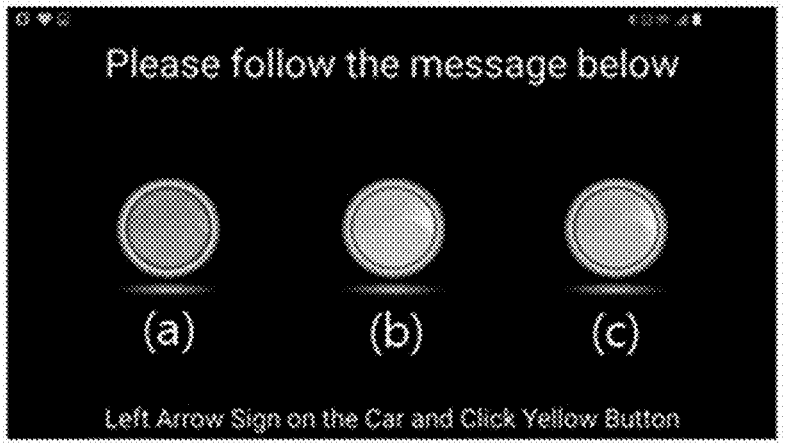
Figure 4C:
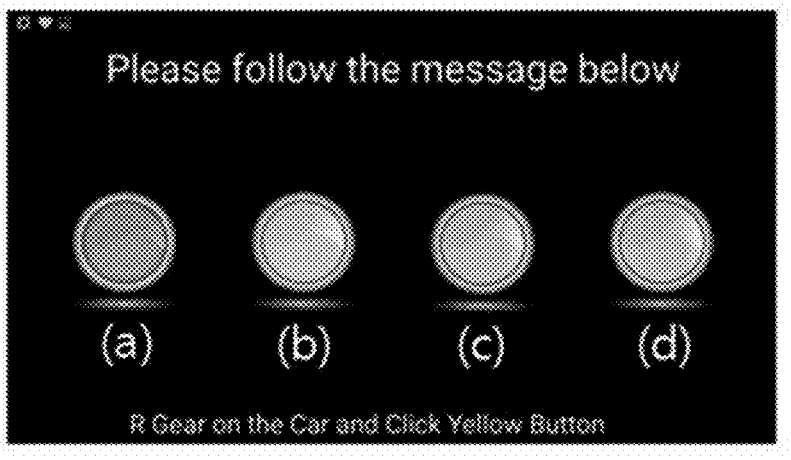

FIGS. 4A to 4C illustrate examples of a display provided for receiving selection input of a user according to example embodiments.

More particularly, FIG. 4A illustrates an example of an initial screen and a verification screen displayed on a user terminal, FIG. 4B illustrates an example of a selection screen for acquiring a non-standard PID of turn signals, and FIG. 4C illustrates an example of a selection screen for acquiring a non-standard PID of gear positions.

Referring to FIG. 4A, a user terminal may provide a user with an initial screen through an application, and the initial screen may provide a button icon which may collect OBD-II data for turn signals and gear positions.

Here, when a user selects an ARROW button on the bottom left through a touch input, a user terminal provides a selection screen as FIG. 4B.

Referring to FIG. 4B, when an initial operation, the user terminal may provide a message which is that Left Arrow Sign on the Car and Click Yellow Button in order that the user may collect initial OBD data in a light-off state of left and right turn signal. Here, colors and positions of a left button (a), a middle button (b), and a right button (c) are arbitrarily designated, and it is illustrated to describe features of colors and unrelated to an operation process. Also, it is unrelated to positions of the left and right buttons of the turn signals.

In FIG. 4, when the user selects the left button (a), the apparatus for acquiring non-standard PID may collect initial OBD data of a vehicle.

Afterwards, the apparatus for acquiring non-standard PID may collect basic OBD data for about 3 seconds, and transmit completing the corresponding operation to the user terminal through a wireless communication method of Bluetooth when the collecting is completed.

After this, the user terminal changes flickering state of the left button (a) to green, changes the middle button (b) to yellow, and may provide a message which is that Click yellow button of the middle button (b) after turning on the left turn signal to the user.

According to the message, when the user clicks the yellow button of the middle button (b) after turning on the left turn signal, the user terminal may transmit an instruction signal to find a non-standard PID corresponding to the left turn signal to the apparatus for acquiring non-standard PID.

Afterwards, when the apparatus for acquiring non-standard PID acquires the non-standard PID corresponding to the left turn signal, it may transmit completing the corresponding operation to the user terminal through the wireless communication method of Bluetooth.

In the next step, the user terminal changes the yellow button of the middle button (b) to green, and may provide a message which is that Click yellow button of the right button (c) after turning on the right turn signal to the user.

According to the message, when the user clicks the yellow button of the right button (c) after turning on the right turn signal, the user terminal may transmit an instruction signal to find a non-standard PID corresponding to the right turn signal to the apparatus for acquiring non-standard PID.

Then, when the apparatus for acquiring non-standard PID acquires the non-standard PID corresponding to the right turn signal, it may transmit completing the corresponding operation to the user terminal through the wireless communication method of Bluetooth.

Finally, the user terminal may provide completing the corresponding operation to the user by changing the right button (c) to green.

Afterwards, according to embodiments, in FIG. 4B, when the user selects a cancel button icon, the user terminal may provide a screen as FIG. 4B again.

Here, the apparatus for acquiring non-standard PID is in a state that the non-standard PID for the turn signal is acquired.

Therefore, when the user turns on left and right turn signals, the apparatus for acquiring non-standard PID may acquire the non-standard PID, and provide a verification screen in FIG. 4A through the user terminal. For example, the user terminal may display the non-standard PID on the verification screen with at least any one of a figure, a value, percent, a video, an image, a graph, a message, and sound. In other words, accordingly, the apparatus for acquiring non-standard PID may acquire and verify the non-standard PID according to the turn signal.

Referring to FIG. 4A, in FIG. 4A, when the user selects a GEAR button on the bottom right through a touch input, the user terminal may provide a selection screen as FIG. 4C.

Referring to FIG. 4C, the user terminal displays button icons (a), (b), (c), (d) corresponding to each of gear positions (P, R, N, D), and the user may acquire a non-standard PID of each of the gear positions while interacting with the apparatus for acquiring non-standard PID through the user terminal.

Here, a method for acquiring a non-standard PID of gear positions is the same with the above-described the method for acquiring a non-standard PID of turn signals in FIG. 4B.

Therefore, when the user changes gear positions of a vehicle, the apparatus for acquiring non-standard PID may acquire a non-standard PID of a corresponding gear position, and provide a verification screen in FIG. 4A through the user terminal. For example, the user terminal may display the non-standard PID on the verification screen at least any one of a figure, a value, percent, a video, an image, a graph, a message, and sound. In other words, accordingly, the apparatus for acquiring non-standard PID may acquire and verify the non-standard PID according to the gear positions.

Figure 5:
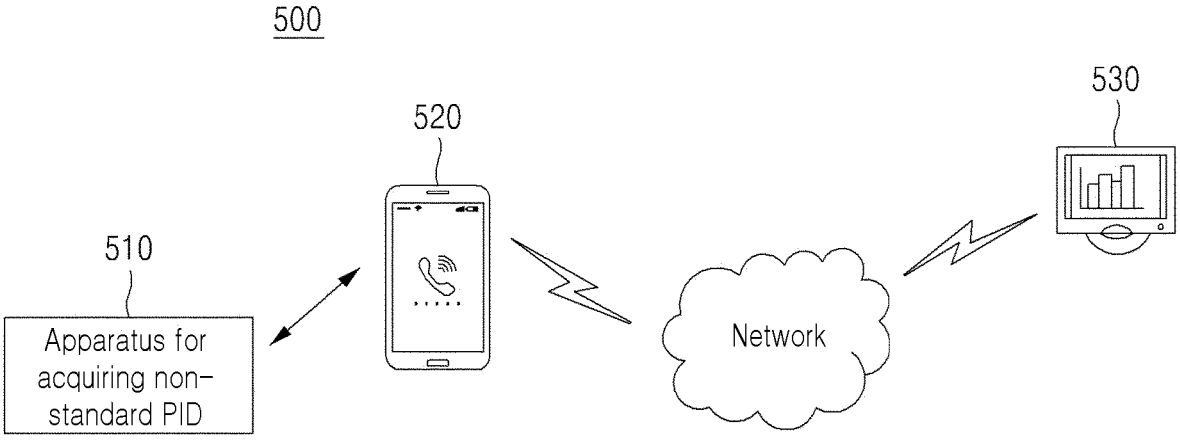
FIG. 5 illustrates a configuration of a system for acquiring non-standard PID according to an example of embodiments.

FIG. 5 illustrates a configuration of a system for acquiring non-standard PID according to an example of embodiments.

Referring to FIG. 5, a system for acquiring non-standard PID provides a non-standard PID acquired from an apparatus for acquiring non-standard PID to a user, and manages through an external server.

For this, the system for acquiring non-standard PID includes an apparatus for acquiring non-standard PID 510, a user terminal 520, and an external server 530.

The apparatus for acquiring non-standard PID 510 is connected to an OBD (On Board Diagnostics) terminal, extracts a non-standard PID (Parameter ID) corresponding to a non-standard operation of a vehicle by using collected OBD data after an instruction signal according to selection input of a user, and monitors the non-standard PID generated according to the non-standard operation.

For example, the apparatus for acquiring non-standard PID 510 may include an OBD data collecting unit connected to an OBD terminal in the vehicle and collecting OBD data according to the non-standard operation of the vehicle, an PID extracting unit extracting the non-standard PID corresponding to the non-standard operation by using collected OBD data after the instruction signal generated by the user terminal 520, a PID monitoring unit storing the non-standard PID corresponding to the vehicle, and monitoring the non-standard PID generated according to the non-standard operation, and a controlling unit receiving the instruction signal according to selection input of the user which is input to the user terminal 520, transmitting a monitoring result of the non-standard PID, and outputting an output signal according to the monitoring result of the non-standard PID.

However, the detailed description related to the apparatus for acquiring non-standard PID 510 is described through FIG. 1, so it will be omitted.

The user terminal 520 transmits the instruction signal according to selection input of the user terminal, and receives and transmits the monitoring result of the non-standard PID.

The user terminal 520 may display a plurality of button icons for the non-standard operation of at least any one of turn signals of left, right, light-off and gear positions of P (Parking), R (Reverse), N (Neutral), and D (Drive) as described in FIGS. 4A to 4C, and transmit the instruction signal according to selection input of the user for the plurality of icons.

For example, the user terminal 520 may receive the non-standard PID according to the non-standard operation of the vehicle from the apparatus for acquiring non-standard PID 510 and the external server 530, output with at least any one of a figure, a value, percent, a video, an image, a graph, a message, and sound, and provide an alarm signal including at least any one of a warning message, alarm, sound, light, and vibrate according to embodiments.

According to embodiments, the user terminal 520 may control the apparatus for acquiring non-standard PID based on control command which is input from the user.

According to embodiments, the user terminal 520 may be at least any one of a terminal, a smart phone, a tablet PC, and a PC which are possessed by the user or a manager, and types of terminals are not limited thereto.

Also, the user terminal 520 may include an application processor for data receiving and transmitting, control command generating and display.

The external server 530 may match and manage the non-standard PID corresponding to the non-standard operation by VIN (Vehicle Identification Number) of vehicles.

According to embodiments, the user terminal 520 may request the non-standard PID corresponding to the non-standard operation of the vehicle having a specific VIN to the external server 530, and the external server 530 may transmit corresponding information to the user terminal 520 when having the non-standard PID.

However, when the external server 530 does not have the non-standard PID corresponding to the non-standard operation of the vehicle having the specific VIN, the external server 530 may request to acquire the non-standard PID according to the non-standard operation of the vehicle having new VIN through the apparatus for acquiring non-standard PID 510 and the user terminal 520.

For example, it is supposed that a user requests a non-standard PID corresponding to VIN to the external server 530 through the user terminal 520 after finding out VIN of a subject vehicle. Accordingly, the external server 530 may analyze manufacturing companies group (three) and vehicle features group (four to nine) by receiving the requested VIN of the subject vehicle. Afterwards, the external server 530 may verify whether the non-standard PID for the same type of vehicles with the subject vehicle exists, and when there is no the same type of vehicles, the external server 530 may request to acquire the non-standard PID according to the non-standard operation of the subject vehicle through the apparatus of acquiring non-standard PID 510 and the user terminal 520.

After this, the external server 530 may match, register, and manage the non-standard PID acquired through the apparatus for acquiring non-standard PID 510 and the user terminal 520 with VIN of the subject vehicle.

On the other hand, the external server 530 may verify whether the non-standard PID for the same type of vehicles with the subject vehicle exists, and when there is the same type of vehicles, the external server 530 may transmit the stored and managed non-standard PID to the user terminal 520. Accordingly, the user terminal 520 may transmit the non-standard PID for the subject vehicle to the apparatus for acquiring non-standard PID 510 and a Black-Box.

Figure 6:
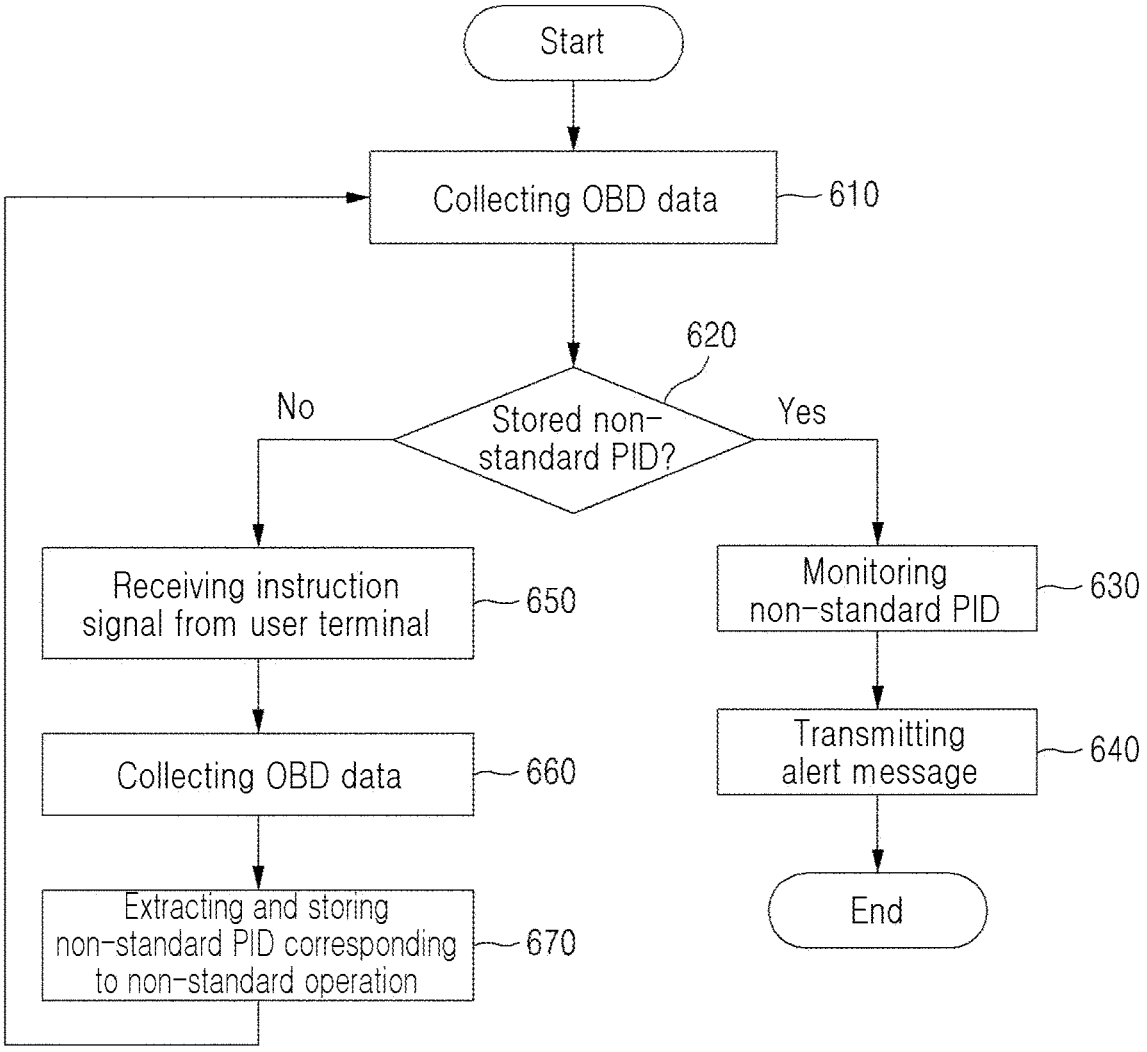
FIG. 6 is a flow chart illustrating a method for acquiring non-standard PID according to example embodiments.

FIG. 6 is a flow chart illustrating a method for acquiring non-standard PID according to example embodiments.

A method described in FIG. 6 may be performed by the apparatus for acquiring non-standard PID described in FIG. 1.

Referring to FIG. 6, in operation 610, an OBD (On Board Diagnostics) terminal in a vehicle is connected, and OBD data according to a non-standard operation of the vehicle is collected.

For example, operation 610 may be an operation for collecting OBD data according to the non-standard operation for changing turn signals and gear positions. However, the non-standard operation of the vehicle is not limited thereto, and may include various operations such as whether a seat belt is worn or not, window operation, lamp operation, and the like. In other words, the non-standard operation of the vehicle to be described in this invention may be motion for acquiring a non-standard PID excepting a standard PID relating to vehicle fault diagnosis.

In operation 620, whether the non-standard PID according to the non-standard operation of the vehicle is stored or not is determined based on the collected OBD data.

As an example of embodiments, when the non-standard PID corresponding to the vehicle is stored based on the determining result, in operation 630, the non-standard PID generated according to the non-standard operation of the vehicle is monitored.

For example, operation 630 may monitor the non-standard PID in the collected OBD data based on the non-standard PID corresponding to various non-standard operations of turn signals, gear positions, whether a seat belt is worn or not in a vehicle, window operation, lamp operation, and the like by VIN of vehicles stored and maintained in a database unit.

Afterwards, in operation 640, a monitoring result of the non-standard PID is output. For example, operation 640 may transmit the monitoring result of the non-standard PID according to the non-standard operation of the vehicle to a user terminal or an external server, and output with at least any one of a figure, a value, percent, a video, an image, a graph, a message, and sound through a verification screen in the user terminal according to an example of embodiments.

As an example of embodiments, when the non-standard PID corresponding to the vehicle is not stored based on the determining result, an instruction signals according to selection input of the user which is input to the user terminal is received in operation 650.

For example, a method for acquiring non-standard PID according to an example of embodiments may inform a lack of the non-standard PID corresponding to the non-standard operation of the vehicle to the user through the user terminal before operation 650, and then, lead selection input of the user for acquiring the non-standard PID.

Here, operation 650 may be an operation receiving the instruction signal according to selection input of the user for the non-standard operation of at least any one of turn signals of left, right, and light-off and gear positions of P (Parking), R (Reverse), N (Neutral), and D (Drive).

Then, in operation 660, preprocessed OBD data according to the non-standard operation of a vehicle is collected.

For example, operation 660 may be an operation detecting the instruction signal according to selection input of the user for the non-standard operation, and collecting preprocessed OBD data according to the non-standard operation received from an OBD (On Board Diagnostics) terminal in the vehicle after the instruction signal.

Afterwards, in operation 670, the non-standard PID corresponding to the non-standard operation is extracted and stored by using the collected OBD data after the received instruction signal.

For example, operation 670 may be an operation extracting the non-standard PID corresponding to the non-standard operation performed by the user based on the instruction signal, and matching and storing the non-standard PID corresponding to various non-standard operations of turn signals, gear positions, whether a seat belt is worn or not, window operation, lamp operation, and the like by VIN (Vehicle Identification Number) of vehicles.

The units described herein may be implemented using hardware components, software components, and/or a combination thereof. For example, a processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will be appreciated that a processing device may include multiple processing elements and multiple types of processing elements. For example, a processing device may include multiple processors or a processor and a controller. In addition, different processing configurations are possible, such as parallel processors.

The software may include a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. In particular, the software and data may be stored by one or more computer readable recording mediums.

The example embodiments may be recorded in non-transitory computer-readable media including program instructions to implement various operations embodied by a computer. The media may also include, alone or in combination with the program instructions, data files, data structures, and the like. The media and program instructions may be those specially designed and constructed for the purposes of the present disclosure, or they may be of the kind well-known and available to those having skill in the computer software arts. Examples of non-transitory computer-readable media include magnetic media such as hard disks, floppy disks, and magnetic tape; optical media such as CD ROM disks and DVD; magneto-optical media such as floptical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter.

While certain example embodiments and implementations have been described herein, other embodiments and modifications will be apparent from this description. Accordingly, the invention is not limited to such embodiments, but rather to the broader scope of the presented claims and various obvious modifications and equivalent arrangements.

DESCRIPTION OF REFERENCES

100, 200: Apparatus for acquiring non-standard PID
300, 520: User terminal

500: System for acquiring non-standard PID

530: External server

What is claimed is:

1. An apparatus for acquiring non-standard PID (Parameter ID) comprising:

an OBD (On Board Diagnostics) data collecting unit configured to collect OBD data according to a non-standard operation of a vehicle connected to an OBD terminal in the vehicle;

a PID (Parameter ID) extracting unit configured to extract a non-standard PID corresponding to the non-standard operation by using the collected OBD data after an instruction signal generated by a user terminal;

a PID monitoring unit configured to store the non-standard PID corresponding to the vehicle, and monitoring the non-standard PID generated according to the non-standard operation; and a controlling unit configured to receive the instruction signal according to selection input of a user which is input to the user terminal, transmit a monitoring result of the non-standard PID, and output an output signal according to the monitoring result of the non-standard PID, wherein the PID extracting unit comprises:

an instruction receiving module receiving the instruction signal generated from the selection input of the user in order to acquire the non-standard PID;

an OBD receiving module receiving preprocessed OBD data for the non-standard operation performed by the user after the instruction signal; and a non-standard PID extracting module extracting the non-standard PID corresponding to the non-standard operation performed by the user based on the instruction signal using at least one of a cross pattern filter and a pattern ratio filter.

2. The apparatus of claim 1, wherein the OBD data collecting unit collects the OBD data generated in the OBD terminal by the non-standard operation of changing turn signals and gear positions of the vehicle.

3. The apparatus of claim 1, wherein the instruction receiving module receives the selection input of the user for the non-standard operation of at least any one of the turn signals of left, right, and light-off and the gear positions of P (Parking), R (Reverse), N (Neutral), and D (Drive).

4. The apparatus of claim 3, wherein the OBD receiving module detects the instruction signal according to the selection input of the user for the non-standard operation, and receives the preprocessed OBD data according to the non-standard operation generated after the instruction signal.

5. The apparatus of claim 1, wherein the PID monitoring unit matches and stores the vehicle, the non-standard operation, and the non-standard PID.

6. The apparatus of claim 5, wherein the PID monitoring unit monitors the non-standard PID generated by the non-standard operation of the vehicle based on the stored data.

7. The apparatus of claim 6, wherein the controlling unit transmits a monitoring result of the non-standard PID to the user terminal and an external server, and outputs the result through an outputting module in the vehicle.

8. A system for acquiring non-standard PID (Parameter ID) comprising:

an apparatus for acquiring non-standard PID (Parameter ID) extracting a non-standard PID corresponding to a non-standard operation of a vehicle by using collected OBD (On Board Diagnostics) data after an instruction signal according to selection input of a user connected to an OBD terminal in the vehicle, and monitoring the non-standard PID generated according to the non-standard operation;

a user terminal transmitting the instruction signal according to the selection input of the user, and receiving and providing a monitoring result of the non-standard PID; and an external server matching and managing the vehicle, the non-standard operation, and the non-standard PID, wherein the apparatus for acquiring non-standard PID comprises:

an OBD data collecting unit configured to collect the OBD data according to the non-standard operation of the vehicle connected to the OBD terminal in the vehicle;

a PID extracting unit configured to extract the non-standard PID corresponding to the non-standard operation by using the collected OBD data after the instruction signal generated by the user terminal;

a PID monitoring unit configured to store the non-standard PID corresponding to the vehicle, and monitor the non-standard PID generated according to the non-standard operation; and a controlling unit configured to receive the instruction signal according to the selection input of the user which is input to the user terminal, transmit a monitoring result of the non-standard PID, and output an output signal according to the monitoring result of the non-standard PID, wherein the non-standard PID extracting module extracting the non-standard PID corresponding to the non-standard operation performed by the user based on the instruction signal using at least one of a cross pattern filter and a pattern ratio filter.

9. The system of claim 8, wherein the user terminal displays a plurality of icons for the non-standard operation of at least any one of turn signals of left, right, and light off and gear positions of P (Parking), R (Reverse), N (Neutral), and D (Drive), and transmits the instruction signal according to the selection input of the user.

10. The system of claim 8, wherein the user terminal requests the non-standard PID corresponding to the non-standard operation for the vehicle to the external server.

11. The system of claim 8, wherein the external server is configured to match and manage the non-standard PID corresponding to the non-standard operation by VIN (Vehicle Identification Number) of vehicles.

12. The system of claim 8, wherein the apparatus for acquiring non-standard PID is configured to be connected to or included in a Black-Box of the vehicle.

* * * * *